United States Patent [19]

Chang

[11] Patent Number: 4,820,353

[45] Date of Patent: Apr. 11, 1989

[54] METHOD OF FORMING FATIGUE CRACK RESISTANT NICKEL BASE SUPERALLOYS AND PRODUCT FORMED

[75] Inventor: Keh-Minn Chang, Schenectady, N.Y.

[73] Assignee: General Electric Company, Schenectady, N.Y.

[21] Appl. No.: 907,271

[22] Filed: Sep. 15, 1986

[51] Int. Cl.[4] ..... C22F 1/10

[52] U.S. Cl. ..... 148/2; 148/3; 148/11.5 N; 148/12.7 N; 148/410; 148/428

[58] Field of Search ..... 148/11.5 N, 12.7 N, 148/428, 410, 2, 3, 162; 420/449

[56] References Cited

U.S. PATENT DOCUMENTS 4,685,977 8/1987 Chang ..... 148/12.7 N

*Primary Examiner*—R. Dean

*Attorney, Agent, or Firm*—Paul E. Rochford; James C. Davis, Jr.; James Magee, Jr.

[57] ABSTRACT

A novel nickel base superalloy is provided. The alloy is unique in having a high enough concentration of $\gamma'$ strengthening precipitate to provide a valuable set of physical properties and yet retain forgeability properties similar to those of alloys having lower concentration of precipitate.

11 Claims, 15 Drawing Sheets

METHOD OF FORMING FATIGUE CRACK RESISTANT NICKEL BASE SUPERALLOYS AND PRODUCT FORMED

RELATED APPLICATIONS

The subject matter of this application relates generally to that of three commonly assigned and concurrently filed applications, the subject matter of which is incorporated herein by reference; as follows: Ser. No. 907,550 filed Sept. 15, 1986; Ser. No. 907,276 filed Sept. 15, 1986; Ser. No. 907,275 filed Sept. 15, 1986.

The subject application also relates generally to the subject matter of application Ser. No. 677,449, filed Dec. 3, 1984 which application is assigned to the same assignee as the subject application herein. The text of the related application is incorporated here by reference.

BACKGROUND OF THE INVENTION

It is well known that nickel based superalloys are extensively employed in high performance environments. Such alloys have been used extensively in jet engines and in gas turbines where they must retain high strength and other desirable physical properties at elevated temperatures of a 1000 F. or more.

It is also well known that in part the desirable combination of properties of such alloys at high temperatures are at least in part due to the presence of a precipitate which has been designated as a $\gamma'$ precipitate. More detailed characteristics of the phase chemistry of $\gamma'$ are given in "Phase Chemistries in Precipitation-Strengthening Superalloy" by E. L. Hall, Y. M. Kouh, and K. M. Chang [Proceedings of 41st. Annual Meeting of Electron Microscopy Society of America, August 1983 (p. 248)].

The following U.S. patents disclose various nickel-base alloy compositions: U.S. Pat. Nos. 2,570,193; 2,621,122; 3,046,108; 3,061,426; 3,151,981; 3,166,412; 3,322,534; 3,343,950; 3,575,734; 3,576,681; 4,207,098 and 4,336,312. The aforementioned patents are representative of the many alloying situations reported to date in which many of the same elements are combined to achieve distinctly different functional relationships between the elements such that phases providing the alloy system with different physical and mechanical characteristics are formed. Nevertheless, despite the large amount of data available concerning the nickel-base alloys, it is still not possible for workers in the art to predict with any degree of accuracy the physical and mechanical properties that will be displayed by certain concentrations of known elements used in combination to form such alloys even though such combination may fail within broad, generalized teachings in the art, particularly when the alloys are processed using heat treatments different from those previously employed.

As alloy products for use in turbines and jet engines have developed it has become apparent that different sets of properties are needed for parts which are employed in different parts of the engine or turbine. For jet engines the material requirements of more advanced aircraft engines continue to become more strict as the performance requirements of the aircraft engines are increased. The different requirements are evidenced, for example, by the fact that many blade alloys display very good high temperature properties in the cast form. However, the direct conversion of cast blade alloys into disk alloys is very unlikely because blade alloys display inadequate strength at intermediate temperatures. Further, the blade alloys have been found very difficult to forge and forging has been found desirable in the fabrication of disks from disk alloys. Moreover, the crack growth resistance of disk alloys has not been evaluated. Accordingly to achieve increased engine efficiency and greater performance constant demands are made for improvements in the strength and temperature capability of disk alloys as a special group of alloys for use in aircraft engines.

The objectives for forgeable nickel-base superalloys of this invention are three-fold: (1) to minimize the time dependence of fatigue cracking resistance, (2) to secure (a) values for strength at room and elevated temperatures and (b) creep properties that are reasonably comparable to those of powder-processed alloys, and (3) to reduce or obviate the processing difficulties encounted heretofore.

A problem which has been recognized to a greater and greater degree with many such nickel based superalloys is that they are subject to formation of cracks or incipient cracks, either in fabrication or in use, and that the cracks can actually propagate or grow while under stress as during use of the alloys in such structures as gas turbines and jet engines. The propagation or enlargement of cracks can lead to part fracture or other failure. The consequence of the failure of the moving mechanical part due to crack formation and propagation is well understood. In jet engines it can be particularly hazardous or even catastrophic.

However, what has been poorly understood until recent studies were conducted was that the formation and the propagation of cracks in structures formed of superalloys is not a monolithic phenomena in which all cracks are formed and propagated by the same mechanism and at the same rate and according to the same criteria. By contrast the complexity of the crack generation and propagation and of the crack phenomena generally and the interdependence of such propagation with the manner in which stress is applied is a subject on which important new information has been gathered in recent years. The period during which stress is applied to a member to develop or propagate a crack, the intensity of the stress applied, the rate of application and of removal of stress to an from the member and the schedule of this application was not well understood in the industry until a study was conducted under contract to the National Aeronautics and Space Administration. This study is reported to a technical report identified as NASA CR-165123 issued from the National Aeronautics and Space Administration in August 1980, identified as "Evaluation of the Cyclic Behavior of Aircraft Turbine Disk Alloys" part II, Final Report, by B. A. Cowles, J. R. Warren and F. K. Hauke, and prepared for the National Aeronautics and Space Administration, NASA Lewis Research Center, Contract NAS3-21379.

A principal unique finding of the NASA sponsored study was that the rate of propagation based on fatigue phenomena or in other words the rate of fatigue crack propagation (FCP) was not uniform for all stresses applied nor to all manners of applications of stress. More importantly, the finding was that fatigue crack propagation actually varied with the frequency of the application of stress to the member where the stress was applied in a manner to enlarge the crack. More surprising still, was the finding from the NASA sponsored study that the application of stress of lower frequencies rather than at the higher frequencies previously employed in studies, actually increased the rate of crack propagation. In other words the NASA study revealed that there was a time dependence in fatigue crack propagation. Further the time dependence of fatigue crack propagation was found to depend not on frequency alone but on the time during which the member was held under stress for a so-called hold-time.

Following the discovery of this unusual and unexpected phenomena of increased fatigue crack propagation and lower stress frequencies there was some belief in the industry that this newly discovered phenomena represented an ultimate limitation on the ability of the nickel based superalloys to be employed in the stress bearing parts of the turbines and aircraft engines and that all design effort had to be made to design around this problem.

The most undesirable time-dependent crack-growth behavior has been found to occur when a hold time is superimposed on a sine curve variation in stress. In such case, a test sample may be subjected to stress in a sine wave pattern but when the sample is at maximum stress the stress is held constant for a hold time. When the hold time is completed, the sine wave application of stress is resumed. According to this hold time pattern the stress is held for a designated hold time each time the stress reaches a maximum in following the normal sine curve. This hold time pattern of application of stress is a separate criteria for studying crack growth. This type of hold time pattern was used in the NASA study referred to above.

However, it has been discovered that it is feasible to construct parts of nickel based superalloys for use at high stress in turbines and aircraft engines with greatly reduced crack propagation rates.

The development of the superalloy compositions and methods of their processing of this invention focuses on the fatigue property and addresses in particular the time dependence of crack growth.

Crack growth, i.e., the crack propagation rate, in high-strength alloy bodies is known to depend upon the applied stress ($\sigma$) as well as the crack length (a). These two factors are combined by fracture mechanics to form one single crack growth driving force; namely, stress intensity K, which is proportional to $\sigma\sqrt{a}$. Under the fatigue condition, the stress intensity in a fatigue cycle may consist of two components, cyclic and static. The former represents the maximum variation of cyclic stress intensity ($\Delta K$), i.e., the difference between $K_{max}$ and $K_{min}$. At moderate temperatures, crack growth is determined primarily by the cyclic stress intensity ($\Delta K$) until the static fracture toughness $K_{IC}$ is reached. Crack growth rate is expressed mathematically as $da/dN \propto (\Delta K)^n$. N represents the number of cycles and n is a constant which is between 2 and 4. The cyclic frequency and the shape of the waveform are the important parameters determining the crack growth rate. For a given cyclic stress intensity, a slower cyclic frequency can result in a faster crack growth rate. This undesirable time-dependent behavior of fatigue crack propagation can occur in most existing high strength superalloys. The design objective is to make the value of da/dN as small and as free of time-dependency as possible.

BRIEF DESCRIPTION OF THE INVENTION

It is, accordingly, one object of the present invention to provide nickel-base superalloy products which are more resistant to cracking.

Another object is to provide a method for reducing the tendency of nickel-base superalloys to undergo cracking.

Another object is to provide articles for use under cyclic high stress which are more resistant to fatigue crack propagation.

Another object is to provide a composition and method which permits nickel-base superalloys to have imparted thereto resistance to cracking under stress which is applied cyclically over a range of frequencies.

Other objects will be in part apparent and in part pointed out in the description which follows.

In one of its broader aspects, objects of the invention can be achieved by providing a composition of the following approximate content in weight %:

| Ingredient | Concentration in weight % |
|---|---|
| Ni | balance |
| Cr | 16 |
| Co | 12 |
| Mo | 5 |
| W | 5 |
| Al | 2.5 |
| Ti | 5 |
| Zr | 0.05 |
| B | 0.03 |
| C | 0.075 |

melting the composition to form a melt, cooling the melt to form an alloy with a $\gamma'$ precipitate content of about 45% by volume solution, annealing the alloy at 1125° C. for 1 hour, and cooling the alloy.

In one of its broader aspects, the components of a novel composition should preferably be within the following ranges:

| Ingredient | Concentration in weight %, From | To |
|---|---|---|
| nickel | balance | |
| chromium | 14 | 18 |
| cobalt | 10 | 14 |
| molybdenum | 4 | 6 |
| tungsten | 4 | 6 |
| aluminum | 2 | 3 |
| titanium | 4 | 6 |
| zirconium | 0.02 | 0.08 |
| boron | 0.01 | 0.05 |
| carbon | 0.0 | 0.10 |

Titanium can be partially replaced by Nb or Ta on an atomic percentage basis to a level less than or equal to 1.5 atomic percent.

BRIEF DESCRIPTION OF THE DRAWINGS

In the description which follows clarity of understanding will be gained by reference to the accompanying drawings in which.

DETAILED DESCRIPTION OF THE INVENTION

Figure 1:
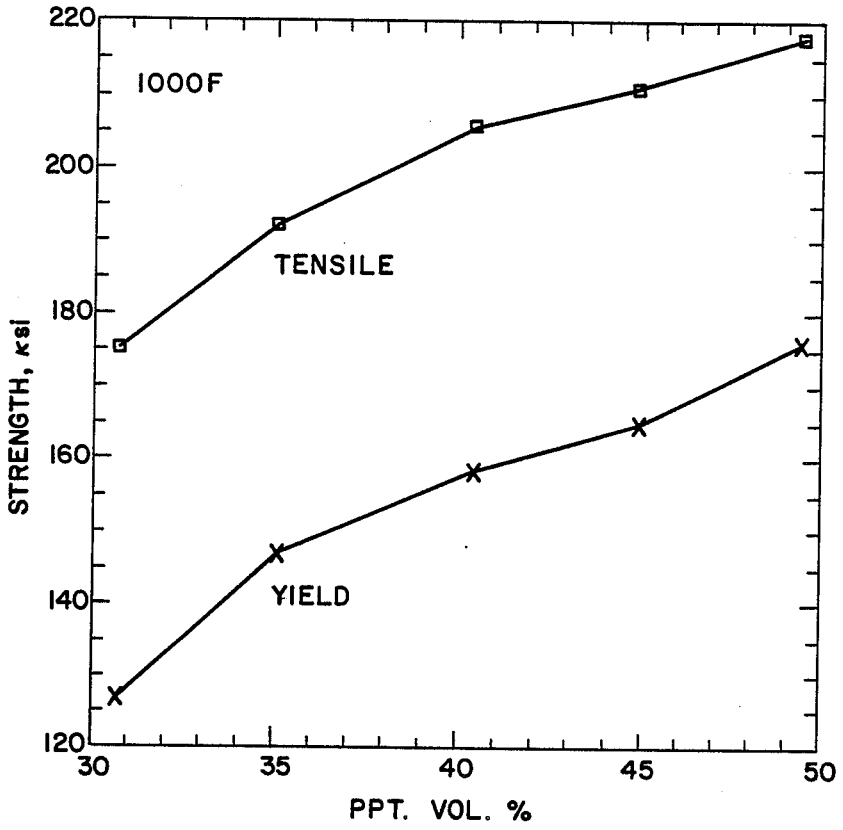
FIG. 1 is a graph of strength as ordinate against volume percent of precipitate as abscissa and in which tensile and yield strength are plotted for five different samples at 1000° F.

It is known that some the most demanding sets of properties for superalloys are those which are needed in connection with jet engine construction. Of the sets of properties which are needed those which are needed for the moving parts of the engine are usually greater than those needed for static parts although the sets of needed properties are different for the different components of an engine.

Because some sets of properties are not attainable in cast alloy materials, resort is sometimes had to the preparation of parts by powder metallurgy techniques. However, one of the limitations which attends the use of powder metallurgy techniques in preparing moving parts for jet engines is that of the purity of the powder. If the powder contains impurities such as a speck of ceramic or oxide the place where that speck occurs in the moving part becomes a latent weak spot where a crack may initiate.

To avoid problems with impure powder and similar problems it is sometimes preferred to form moving parts of jet engines such as disks with alloys which can be cast and wrought.

Pursuant to the present invention a superalloy which can be cast and wrought and also a method for processing this superalloy to produce materials with a superior set or combination or properties for use in advanced engine disk applications is provided. The properties which are conventionally needed for materials used in disk applications include high tensile strength and high stress rupture strength. In addition the alloy of the subject invention exhibits a desirable property of resisting crack growth propagation. Such ability to resist crack growth is essential for the component LCF or low cycle fatigue life of the part.

In addition to this superior set of properties as outlined above, the alloy of the present invention displays good forgeability and such forgeability permits greater flexibility in the use of various manufacturing processes needed in formation of parts such as disks for jet engines.

Accordingly what was sought in undertaking the work which lead to the present invention was the development of a disk alloy having a low or minimum time dependence of fatigue crack propagation and moreover a high resistance to fatigue cracking. In addition what was sought was a balance of properties and particularly of tensile, creep and fatigue properties. Further and in addition to the other sets of requirements what was sought was an ease of processing capabilities for fabrication into disk alloys and this requirement largely resided in a forgeability of the alloy.

These sets of properties are to some degree incompatible as, for example, in the case of tensile properties it has been recognized that a high content of precipitate is favorable to achieving a high tensile strength. Yet it has also been recognized that a high concentration of precipitate limits the susceptibility of the alloy to being forged. What has been achieved in the subject invention, however, is a alloy disk material which has a high concentration of precipitate but which nevertheless retains good forgeability. By itself, this is an unusual combination of desirable properties.

The invention and the manner in which it can be carried out will be made clearer by the examples and discussion of the examples which follow.

Examples 1–5

A set of five alloy compositions, identified as HW-1 for example 1 and HW-5 for example 5 were prepared. The compositions had different alloy content and the alloy content is as listed in Table I below.

TABLE I

Chemical Compositions of Alloy Series to Optimize Precipitate Volume Fraction

| | COMPOSITION, wt % | | | | |
|---|---|---|---|---|---|
| Alloy | HW-1 | HW-2 | HW-3 | HW-4 | HW-5 |
| Ni | bal. | bal. | bal. | bal. | bal. |
| Cr | 15.00 | 15.00 | 15.00 | 15.00 | 15.00 |
| Co | 10.00 | 10.00 | 10.00 | 10.00 | 10.00 |
| Mo | 4.00 | 4.00 | 4.00 | 4.00 | 4.00 |
| Al | 1.70 | 2.00 | 2.40 | 2.75 | 3.10 |
| Zr | 0.05 | 0.05 | 0.05 | 0.05 | 0.05 |
| Ti | 3.00 | 3.60 | 4.30 | 4.90 | 5.50 |
| B | 0.01 | 0.01 | 0.01 | 0.01 | 0.01 |
| C | 0.02 | 0.02 | 0.02 | 0.02 | 0.02 |

What will be noted from a study of Table I is that the components of the composition which are altered going from HW-1 to HW-5 are the aluminum and titanium components. From a study of the Table it is evident that the aluminum concentration is varied from 1.70 wt.% for HW-1 to 3.10 wt.% for HW-5. Similarly the titanium concentration is varied from 3.00 for HW-1 (of Example 1) to 5.50 for HW-5 (of Example 5).

The individual alloys HW-1 to HW-5 of the five examples were prepared by conventional casting and extrusion processing.

The volume fraction in percent of the precipitate was then calculated and the precipitate solvus temperature was measured. The data was recorded and is set forth in Table 2 below.

TABLE II

| Property | HW-1 | HW-2 | HW-3 | HW-4 | HW-5 |
|---|---|---|---|---|---|
| Precipitate vol. % | 31 | 35 | 40 | 45 | 50 |
| Precipitate Solvus | 960 C. | 1020 C. | 1088 C. | 1115 C. | 1150 C. |
| Extrusion Temperature | 950 C. | 1010 C. | 1075 C. | 1105 C. | 1140 C. |
| Anneal Temperature | 1000 C. | 1050 C. | 1075 C. | 1100 C. | 1125 C. |

As is evident from Table II the extrusion temperature was also recorded and there is further recorded the anneal temperature of the five samples HW-1 through HW-5 of the five respective examples.

The individual alloys were each then successively heat treated by a schedule which included a solution anneal plus an aging some details of which are discussed below.

In the effort to obtain a highly desirable set of properties for a disk alloy a study was first made of the influence of the volume fraction of precipitate on some of the properties of the composition formed. For this purpose variation in the concentration of aluminum and titanium in five separate compositions was carried out for Examples 1-5 as set forth in Table I above. Tensile properties of the resulting compositions were measured at 1000° F. as a function of the precipitate volume fraction. Both yield and tensile strengths were measured and both strengths were found to increase monotonically as the volume fraction of precipitate in the composition was increased over the range of 30 to 50 volume %. The data obtained by measurement of tensile and yield strength of the samples which had been formed when maintained at a temperature of 1000° F. are plotted in FIG. 1.

Figure 2:
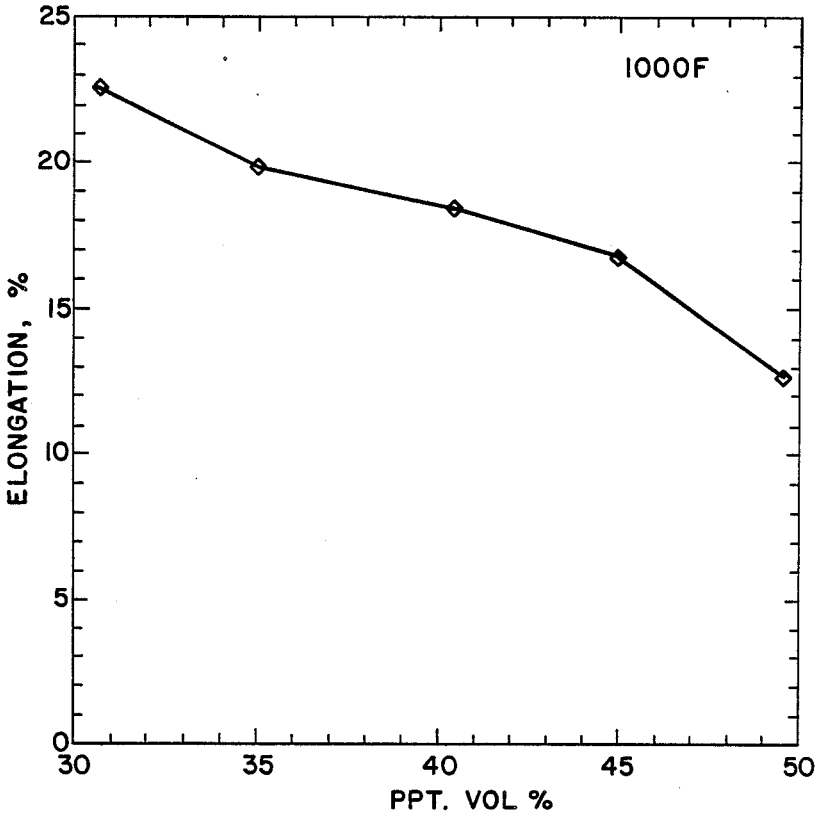
FIG. 2 is a similar graph showing elongation in percent as ordinate and volume percent as abscissa and in which the ductility is plotted for a sample tested at 1000° F.

Ductility measurements were made on samples corresponding to those shown in FIG. 1 and the resulting data is plotted in FIG. 2. It is evident from the plot of FIG. 2 that there is a sharp dropoff in ductility as the precipitate content approaches 50%.

Similar observations relating to tensile properties and elongation were found at other temperatures ranging from room temperature to 1400° F.

Figure 3:
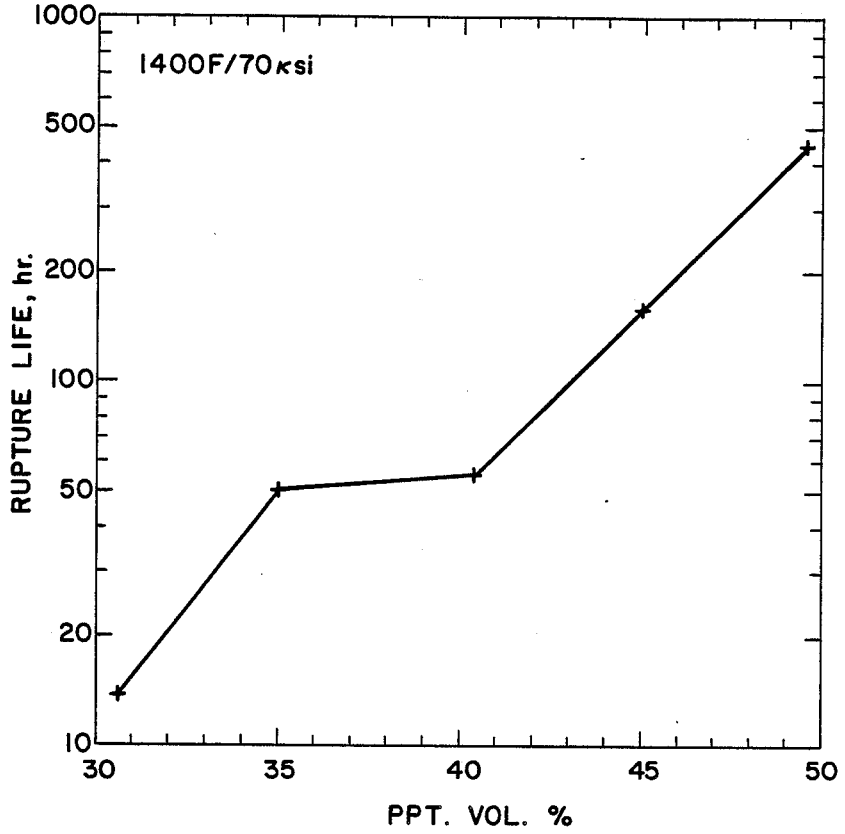
FIG. 3 is a graph in which the rupture life in hours is plotted as ordinate against the volume percent of precipitate for five samples at 70 ksi stress and 1400° F.

Stress rupture life tests were measured at 1400° F. and 70 ksi to determine the relationship between such stress rupture life and the volume percentage of precipitate. Rupture life was found to increase with increasing volume fraction of precipitate and a general proportionality was observed as is evident from the data plotted in FIG. 3.

Figure 4:
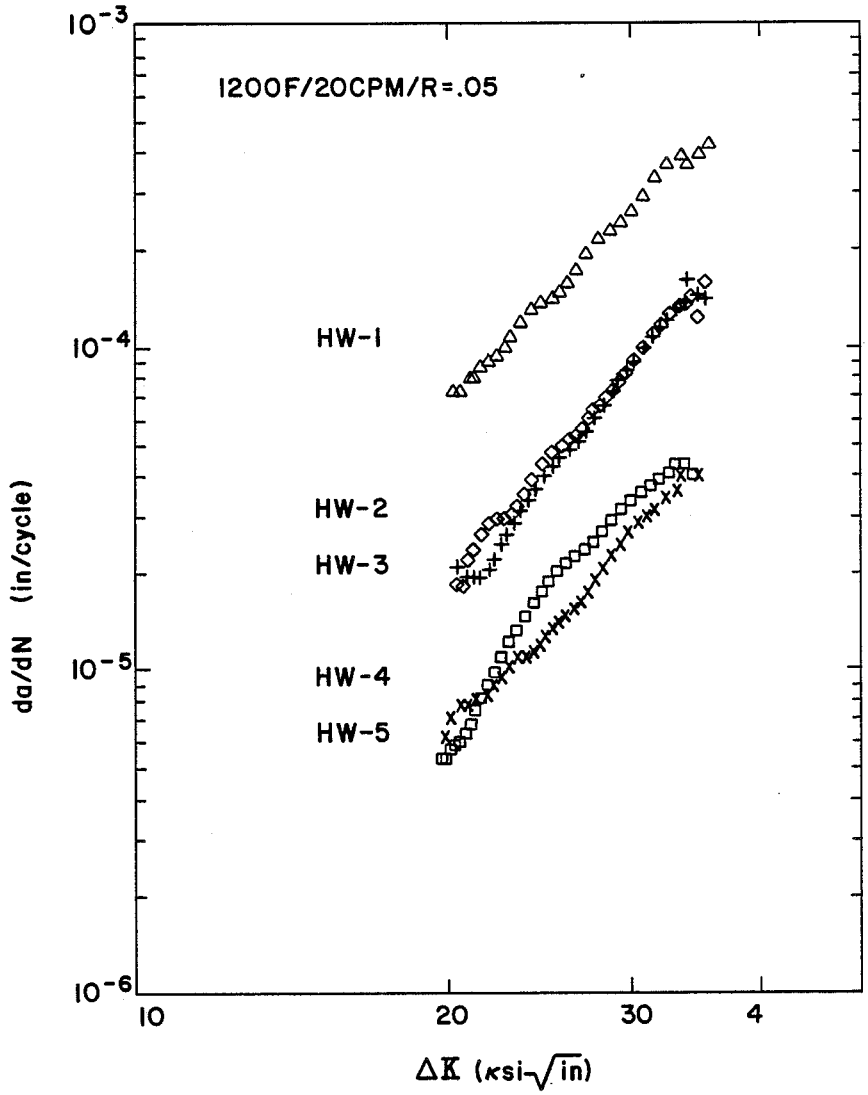
FIG. 4 is a graph in which the rate of crack propagation in inches per cycle is plotted as ordinate against the applied stress in ksi square root in inches, for a sample measured at 1200° F. at a rate of 20 cycles per minute for the four samples referred to above.

Fatigue crack growth rate was measured for these samples of Examples 1-5 and the data is plotted in FIG. 4 for the respective samples HW-1 through HW-5. This data indicates that there is a tendency for a better crack growth resistance to be found in alloys containing higher volume fractions of precipitate.

From the mechanical property viewpoint the good disk and the preferred disk and, in fact, the ideal disk alloy preferably has a high content of precipitate phase but only to the extent that the ductility remains above the level which permits reliable mechanical manufacture. From the experiments performed in these examples and from the data plotted on the respective figures and listed in the respective tables, the optimum content of precipitate was identified to be about 45%. What has also been found and what is very important to the qualification of such mechanical tests for disk alloy use is that the approximate 45% precipitate level is the one which does permit highly successful forging of a cast disk alloy to a structure suitable for use in an aircraft engine.

Example 6

A composition that has a precipitate content corresponding to that of HW-4 of Example 4 above was prepared and the processing parameters of this composition were studied. The composition had a different set of ingredients but had a precipitate content corresponding closely to that of HW-4. The composition was identified as CH-60 and had the following ingredient content:

| Ingredient | Concentration in weight % |
|---|---|
| Ni | balance |
| Cr | 16 |
| Co | 12 |
| Mo | 5 |
| W | 5 |
| Al | 2.5 |
| Ti | 5.0 |
| Zr | 0.05 |
| B | 0.03 |
| C | 0.075 |

An ingot of this alloy was first prepared by vacuum induction melting. The ingot had a 4" diameter. It was forged into a 2" thick pancake. The final forging temperature was set at 1100° C. and the height of the ingot was reduced by 50%.

Yield and tensile strength of the alloy sample identified as CH-60 alloy for this example were studied. Samples were solution annealed at different temperatures ranging from 1050° to 1175° C. and the tensile properties were then measured at 1200° F. Results of this study are set forth in FIG. 5. It is evident from the figure that alloy CH-60 has a significantly high strength in comparison with other available superalloys.

Figure 5:
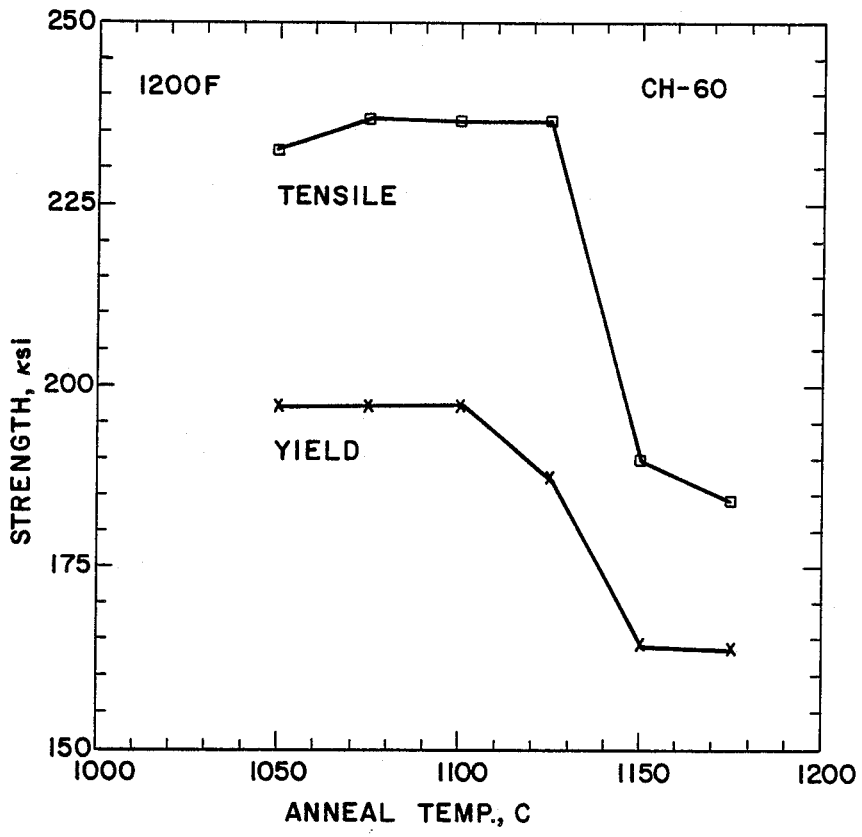
FIG. 5 is a plot in which strength in ksi is plotted as ordinate against the annealing temperature in °C. for a sample of an alloy as set out above at a set of different annealing temperatures.

It is also from FIG. 5 that both the yield and tensile strengths decrease rapidly as the solution anneal temperature is raised above 1150° C.

Figure 6:
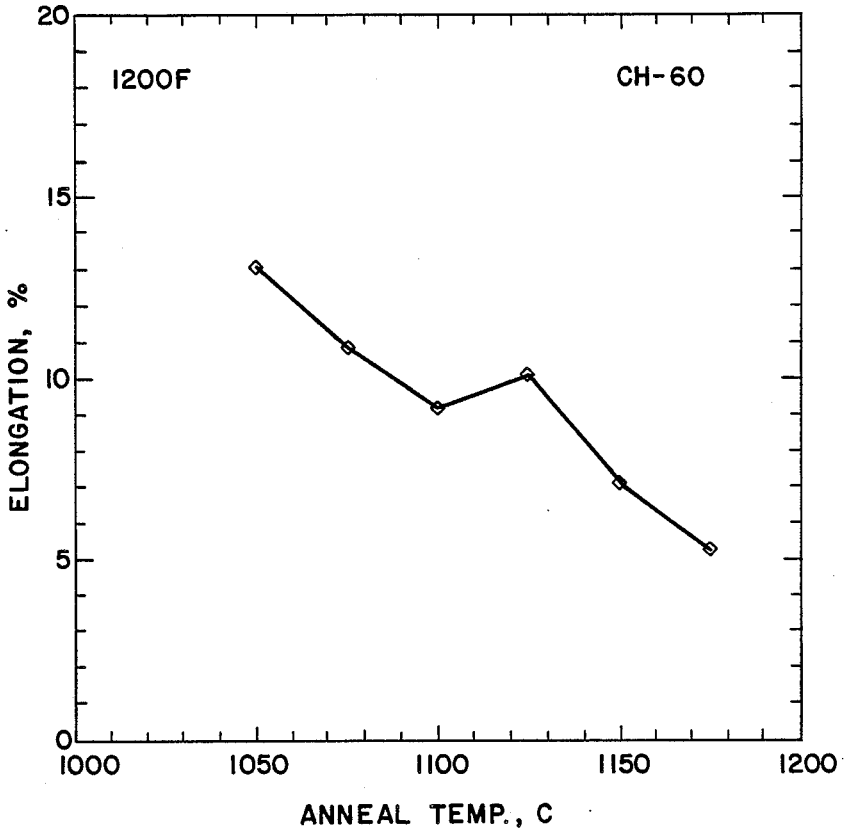
FIG. 6 is a graph showing elongation in percent as ordinate plotted against annealing temperature in °C. as abscissa for the sample of alloy measured at 1200° F. at a number of annealing temperatures.

A similar study was conducted of the ductility of the alloy at 1200° F. after solution anneals at a variety of temperatures as illustrated in FIG. 6. It is evident from FIG. 6 as well that the ductility decreases rapidly as the solution anneal temperature is raised above 1150° C. A metallographic study was made of the specimens of alloy CH-60 and these studies revealed a large grain size and in fact grains having average diameters larger than 150 μm. The loss of strength and ductility is attributed to the large grain size of the samples.

Example 7

Based on the studies conducted in Example 6 further tests of anneal temperatures were carried out. Samples of the CH-60 alloy were prepared and annealed at temperatures of 1050° C., 1100° C. and 1125° C. It was found that the annealing at 1125° C. produces a fine equiaxed structure of grains having an average diameter of about 20 μm. It was also observed for the other annealed samples that different degrees of partial recrystallization had occurred for the samples annealed at 1050° C. and 1100° C. It was further observed that a typical "necklace" metallographic structure was developed for the sample which was annealed at 1100° C.

For the sample which had been annealed at 1050° C. it was observed that a large portion of deformed grains are maintained. For all of the samples in Examples 6 and 7 the samples were chamber cooled after annealing and following the chamber cooling all specimens were given an aging treatment at 760° C. for 16 hours.

The tensile properties of aged CH-60 alloy which had been annealed at different temperatures were studied. The results of these studies are listed in Table III for measurements made at 1200° F. and at 1400° F. The data tabulated in Table III indicate that quite comparable strengths were developed from the anneals at the different temperatures.

TABLE III

| Tensile Properties of Aged CH-60 Alloy Annealed at Different Temperatures | | | |
|---|---|---|---|
| Anneal Temp. | Y.S. (ksi) | T.S. (ksi) | El. (%) |
| | 1200 F. TEST | | |
| 1050 C. | 178 | 224 | 15 |
| 1100 C. | 174 | 228 | 8 |
| 1125 C. | 178 | 239 | 11 |
| | 1400 F. TEST | | |
| 1050 C. | 160 | 170 | 17 |
| 1100 C. | 166 | 178 | 16 |
| 1125 C. | 162 | 171 | 30 |

Next stress rupture life was measured at 1400° F. and 75 ksi. The results of these studies are tabulated in Table IV.

TABLE IV

| 1400/75 ksi Stress Rupture Life of Aged CH-60 Alloy Annealed at Different Temperatures | | |
|---|---|---|
| Anneal Temp. | Rupture Life | Elong. |
| 1050 C. | 66 hr | 6% |
| 1100 C. | 37 hr | 13% |
| 1125 C. | 589 hr | 5% |

It is obvious from the results reported in Table IV that specimens which are annealed at about 1125° C. stand out as the best material in temperature capability. It is particularly evident from the stress rupture life test where the stress rupture life for a sample annealed at 1125° C. is one order of magnitude greater than those of the samples annealed at 1050° C. and 1100° C.

Fatigue cracking resistance was evaluated at 1200° F. for the samples using three cyclic waveforms. The cyclic waveforms used and the sequence of the periods are similar to those employed in the NASA study referred to above in the background statement of this application. Three cyclic waveforms are as follows. First, a three second period of application of stress and removal of stress in a sinusoidal pattern. Next, a 180 second period of application and removal of stress in a sinusoidal pattern. The third cycle is a three second period of application of stress and 177 second period of holding the sample at maximum load stress on the sinusoidal curve.

The studies made and the results obtained are set forth in the FIGS. 7–15 in sets of three. Thus, FIG. 7 displays the results obtained for the three second period. The FIG. 8 displays the results obtained for the 180 second period and FIG. 9 displays the results obtained for the three second plus the 177 second hold periods. In the FIGS. 7, 8 and 9 the data plotted is for a sample as prepared above and a comparative sample is a sample of René 95 metal well known in the industry as a superalloy.

Figure 7:
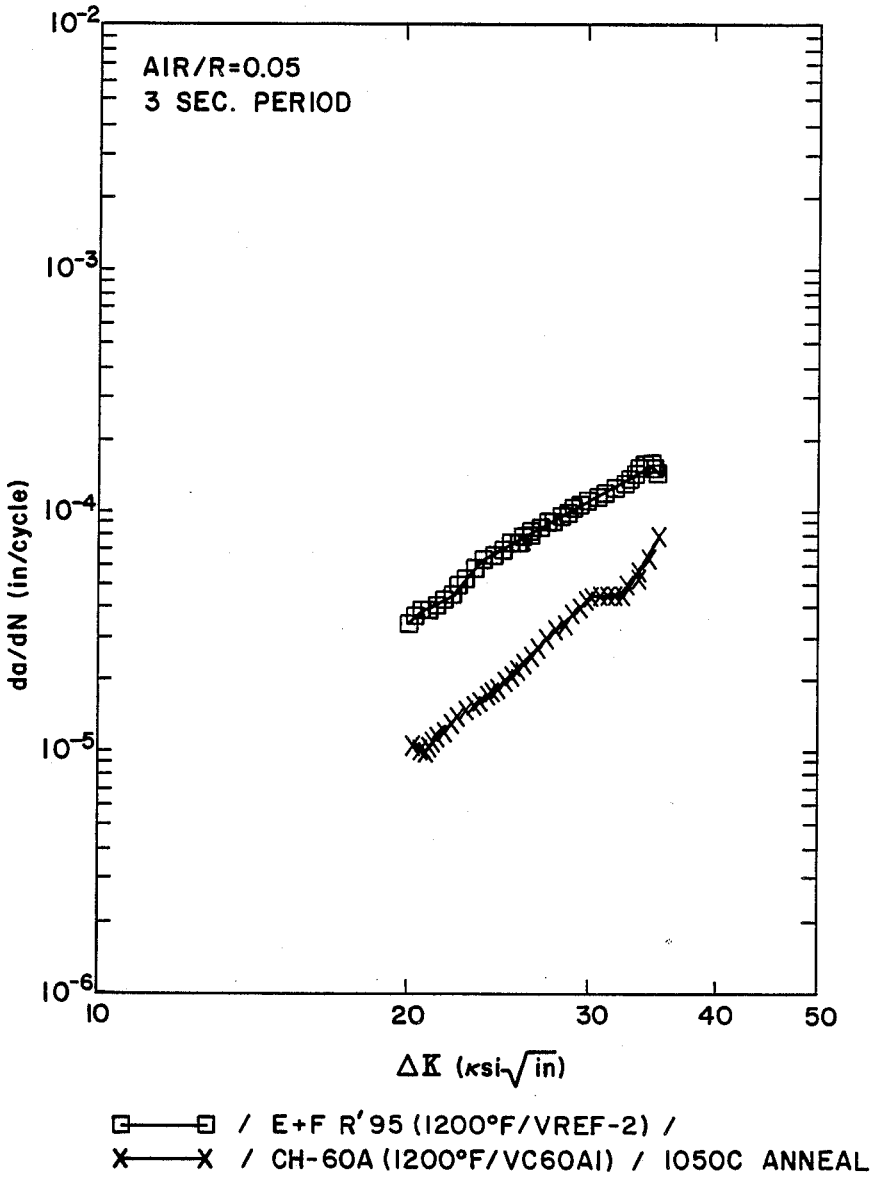
FIGS. 7 through 15 are individual plots in which the rate of fatigue crack propagation is plotted as ordinate against the stress applied to a sample in ksi per square root of crack length in inches for a number of different periods and at a number of different temperatures as shown on the graphs.
Figure 8:
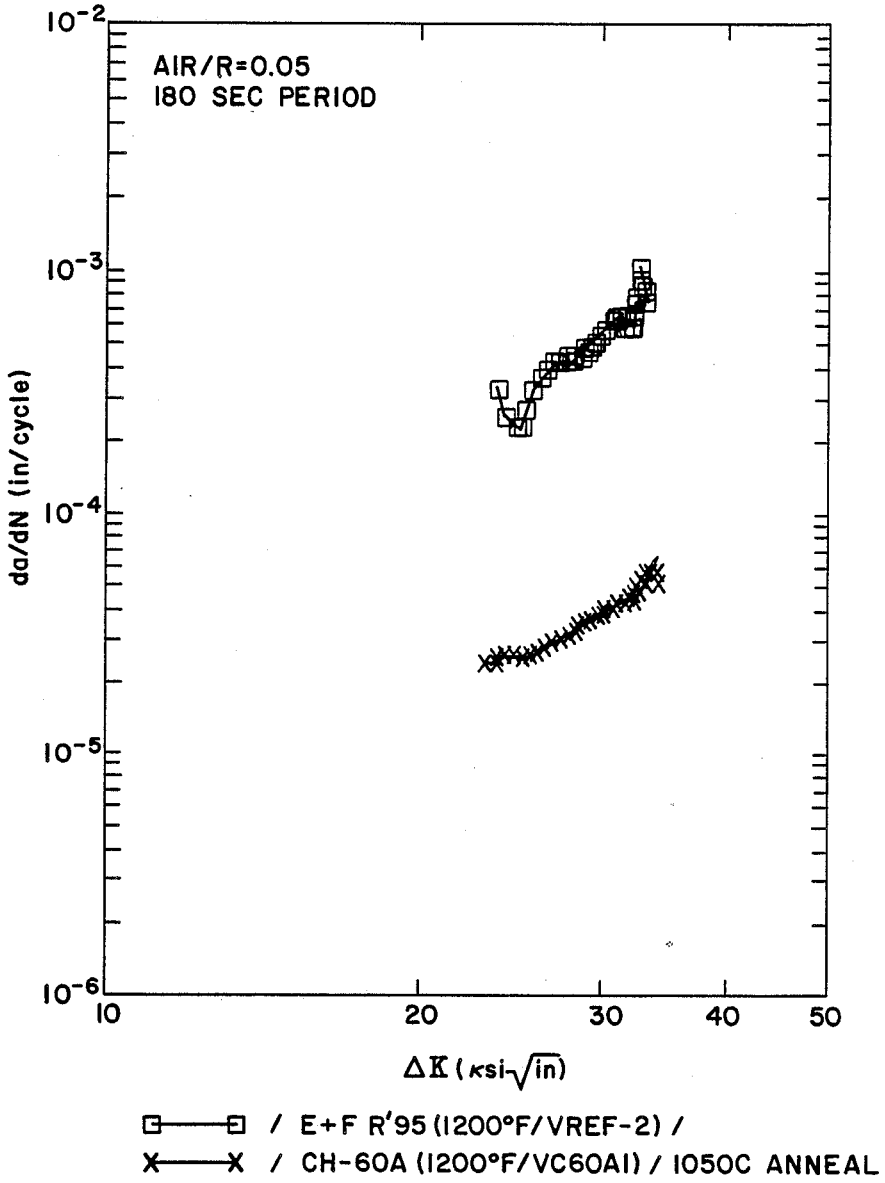
Figure 9:
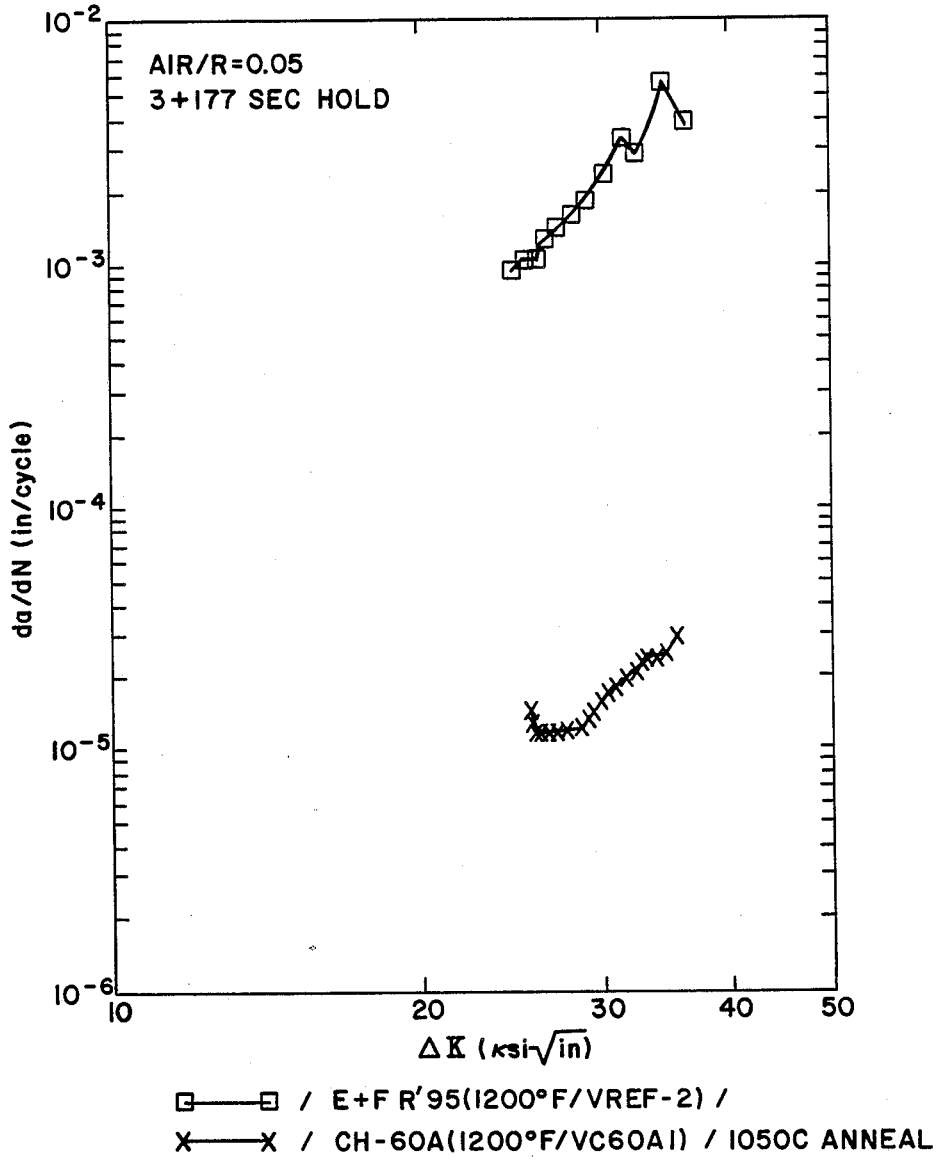
Figure 10:
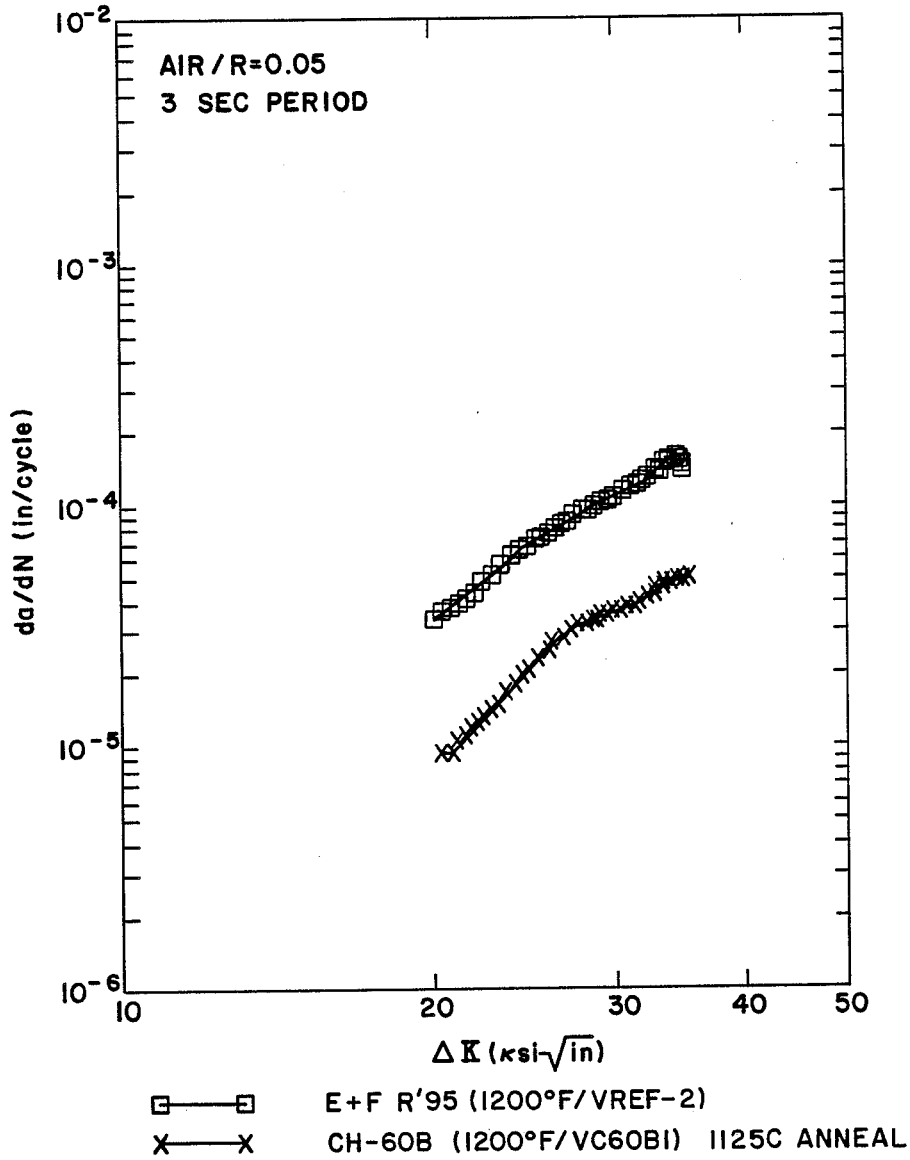
Figure 11:
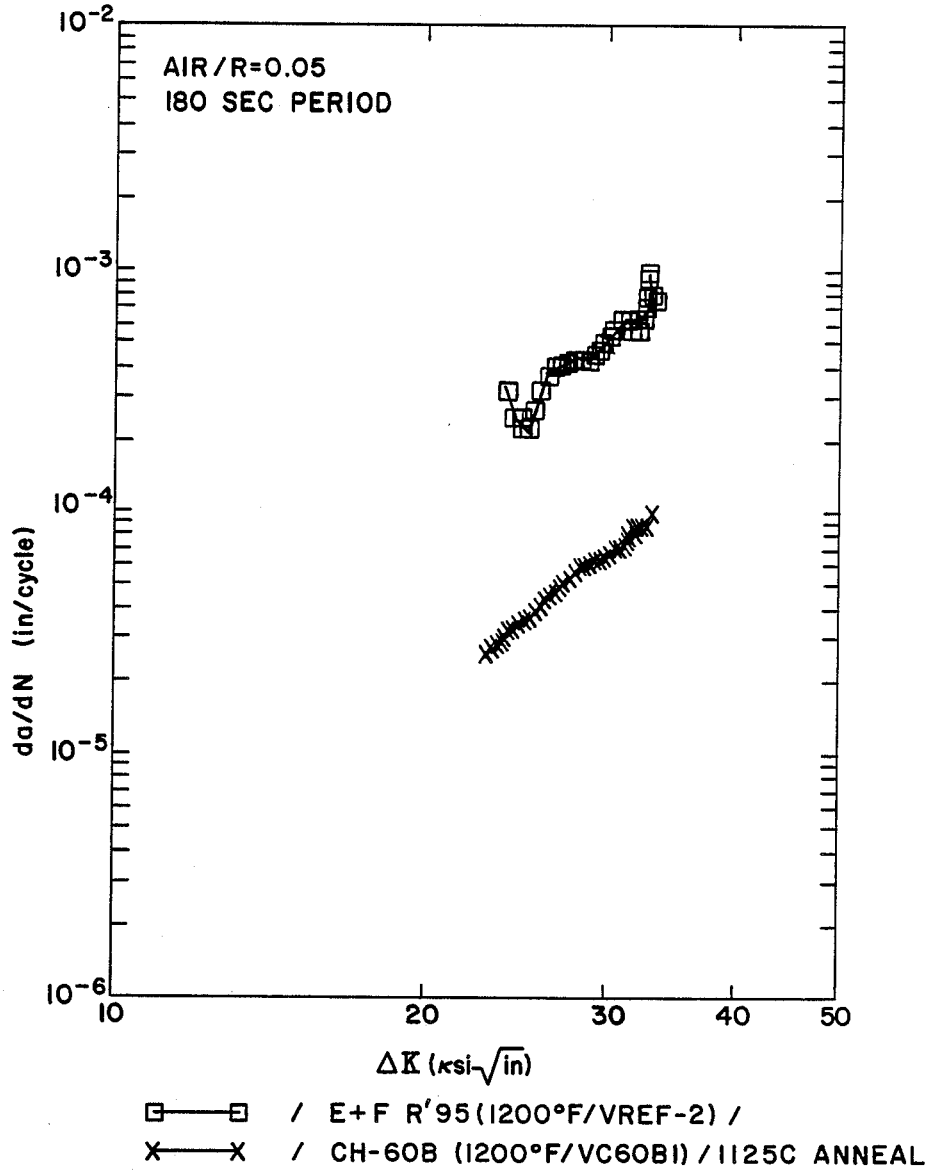
Figure 12:
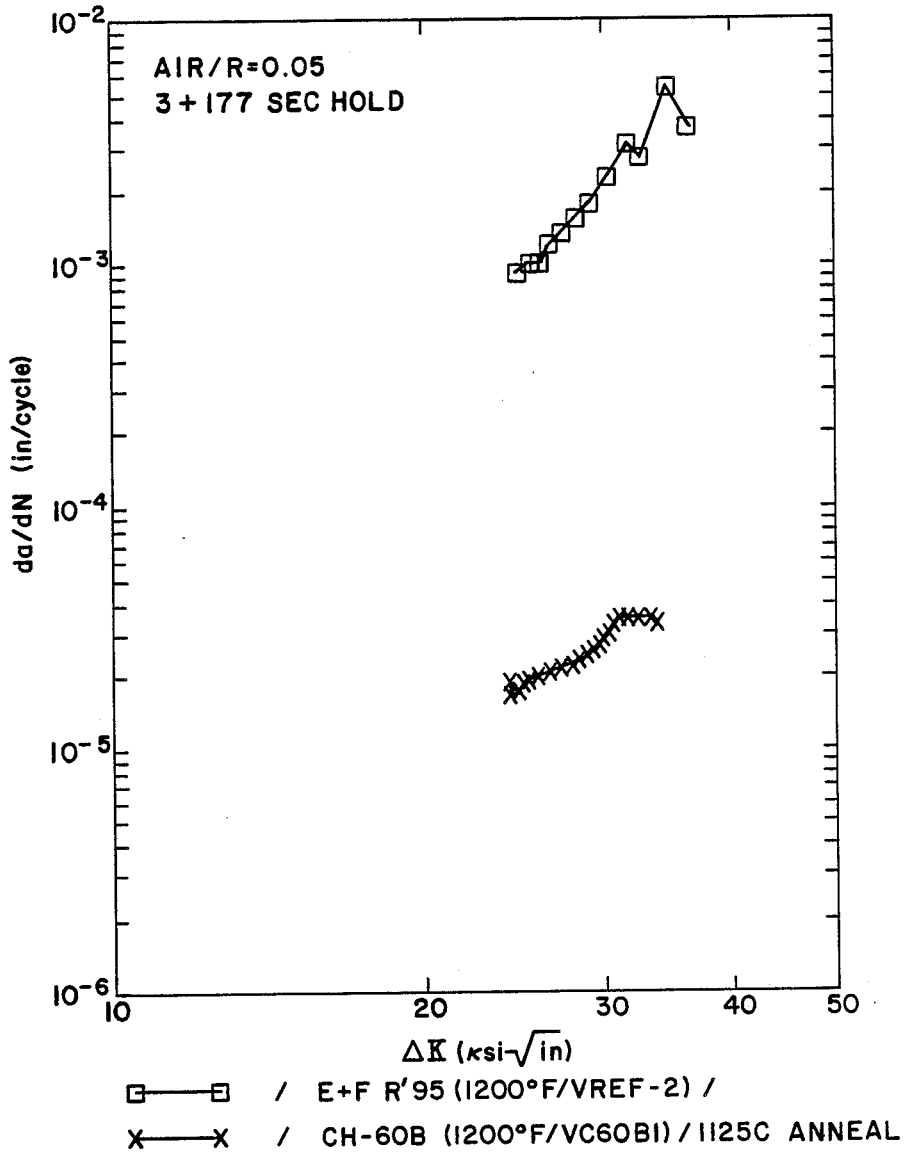
Figure 13:
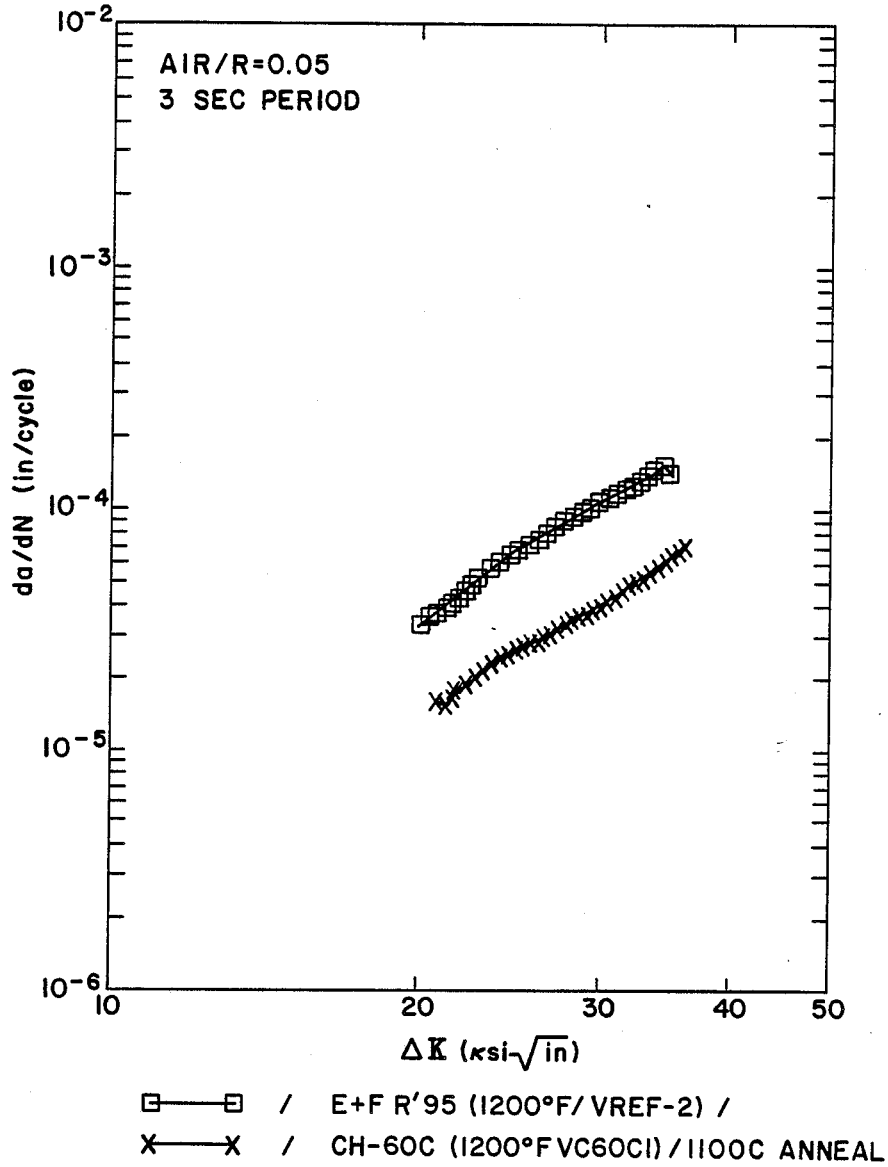
Figure 14:
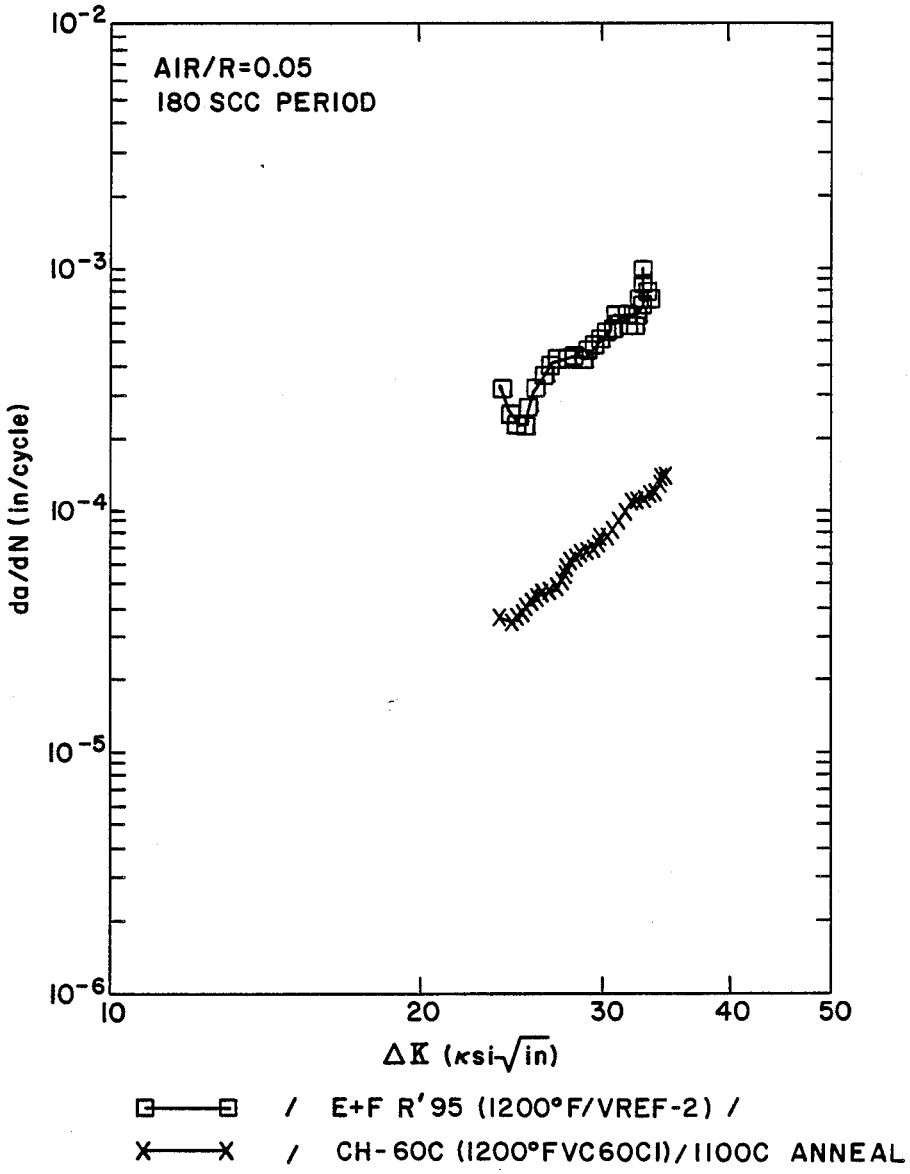
Figure 15:
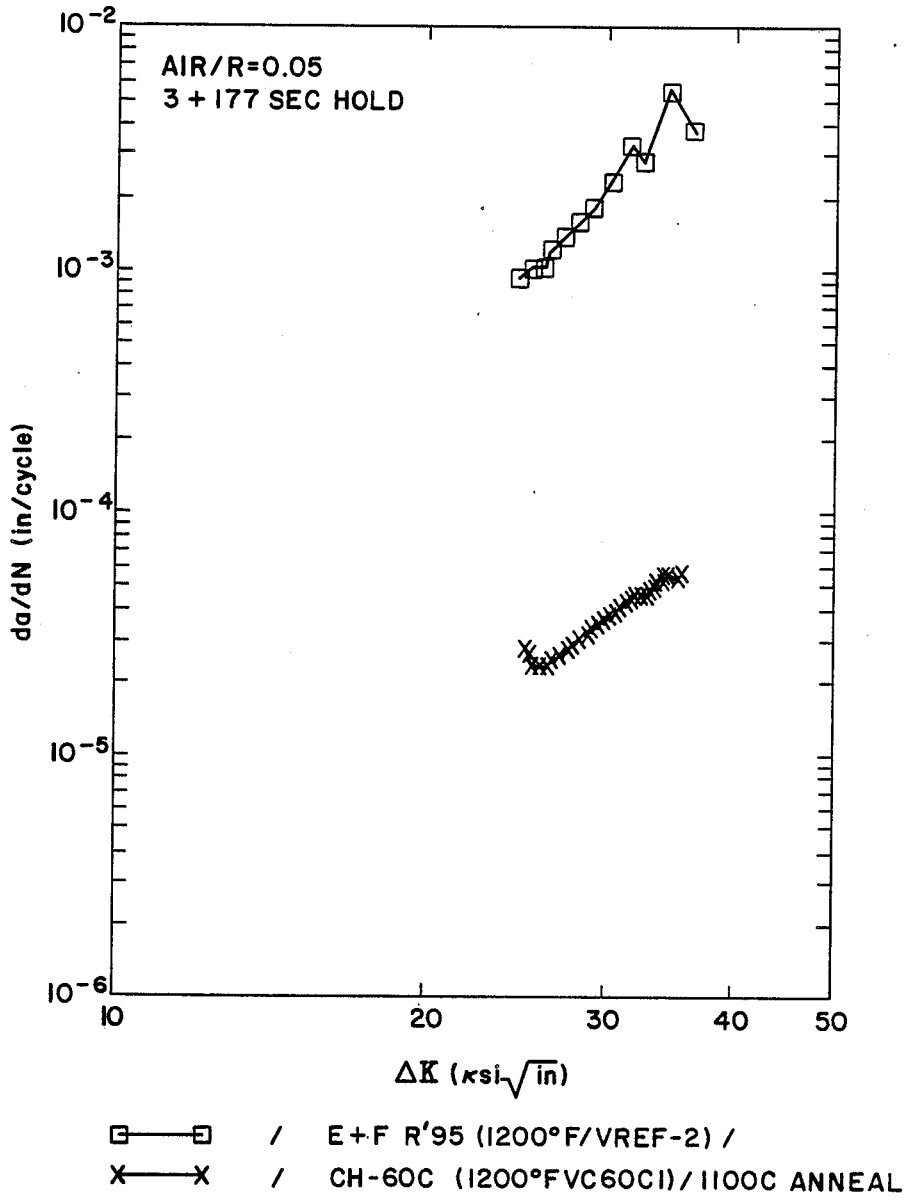

The results displayed in FIGS. 7, 8 and 9 are for samples which were annealed at 1050° C. Those displayed in FIGS. 10, 11 and 12 are those obtained for specimens annealed at 1100° C. The results displayed in FIGS. 13, 14 and 15 are those for specimens annealed at 1125° C.

It is evident from comparison of the results plotted in the set of FIGS. 7-15 that the improvement in crack growth resistance is truly remarkable and also evident that the improvement is especially remarkable at the slow frequencies.

Also it is evident from the figures that the sample annealed at 1050° C. appears to offer a slightly better fatigue crack propagation resistance rate at the hold time tests.

From the foregoing, it is evident that a unique and reworkable combination of properties has been achieved in a novel alloy composition as taught in this application.

Moreover, teachings have been provided herein of the steps and processes by which properties of the alloy composition can be optimized for a variety of different applications to which the alloy may be put.

What is claimed and sought to be protected by Letters Patent of the United States is as follows:

1. A nickel base superalloy which comprises an alloy consisting essentially of the following approximate composition in percentage by weight:

| Ingredient | From | To |
|---|---|---|
| nickel | balance | |
| chromium | 14 | 18 |
| cobalt | 10 | 14 |
| molybdenum | 4 | 6 |
| tungsten | 4 | 6 |
| aluminum | 2 | 3 |
| titanium | 4 | 6 |
| zirconium | 0.02 | 0.08 |
| boron | 0.01 | 0.05 |
| carbon | 0.0 | 0.10 |

said alloy being supersolvus annealed and slowly cooled.

2. The alloy of claim 1 which contains about 45 volume percent of $\gamma'$ precipitate.

3. The alloy of claim 1 which has a relatively high percentage content of $\gamma'$ precipitate but which retains forgeability.

4. The alloy of claim 1 in which the average grain diameter is less than about 30 $\mu$m.

5. The method of preparing a nickel-base superalloy which has a high content of $\gamma'$ precipitate but which retains good forgeability which comprises preparing a melt to consist essentially of the following ingredients,

| Ingredient | Concentration in weight percent | |
|---|---|---|
| | From | To |
| nickel | balance | |
| chromium | 14 | 18 |
| cobalt | 10 | 14 |
| molybdenum | 4 | 6 |
| tungsten | 4 | 6 |
| aluminum | 2 | 3 |
| titanium | 4 | 6 |
| zirconium | 0.02 | 0.08 |
| boron | 0.01 | 0.05 |
| carbon | 0.0 | 0.10 |

casting the melt to form an ingot, supersolvus annealing the ingot, slowly cooling the ingot after the anneal at a rate below 240° F./min.

6. The alloy of claim 5 wherein the alloy is aged following the slow cooling.

7. The alloy of claim 5 wherein the supersolvus anneal is at about 1125° C.

8. The alloy of claim 5 wherein the volume percent of precipitate formed is about 45 volume percent.

9. The method of claim 5 wherein the cast alloy is forged to final shape.

10. The method of claim 5 in which the alloy is chamber cooled and then aged.

11. The method of claim 5 wherein the anneal is done at 1050° C. and the alloy displays a slightly better fatigue crack propagation resistance rate for hold time tests.

* * * * *